US009687416B2

(12) United States Patent
Turner

(10) Patent No.: US 9,687,416 B2
(45) Date of Patent: Jun. 27, 2017

(54) NEUROMUSCULAR THERAPY DEVICE AND METHOD

(76) Inventor: Thomas W. Turner, Powell, OH (US)

( * ) Notice: Subject to any disclaimer, the term of this patent is extended or adjusted under 35 U.S.C. 154(b) by 317 days.

(21) Appl. No.: 14/236,513

(22) PCT Filed: Aug. 9, 2012

(86) PCT No.: PCT/US2012/050125

§ 371 (c)(1),
(2), (4) Date: Jan. 31, 2014

(87) PCT Pub. No.: WO2013/023044

PCT Pub. Date: Feb. 14, 2013

(65) Prior Publication Data

US 2014/0180331 A1 Jun. 26, 2014

Related U.S. Application Data

(60) Provisional application No. 61/521,418, filed on Aug. 9, 2011.

(51) Int. Cl.
*A61H 39/04* (2006.01)
*A61H 1/00* (2006.01)
(Continued)

(52) U.S. Cl.
CPC ..... *A61H 39/04* (2013.01); *A61H 1/008* (2013.01); *A61H 1/0292* (2013.01); *A61H 7/002* (2013.01); *A61H 2201/0126* (2013.01); *A61H 2201/0157* (2013.01); *A61H 2201/1284* (2013.01); *A61H 2205/065* (2013.01); *A61H 2205/125* (2013.01); *F04C 2270/041* (2013.01)

(58) Field of Classification Search
CPC ..... A61H 1/008; A61H 1/0292; A61H 2205/081; A61H 2201/1284; A61H 39/04
See application file for complete search history.

(56) References Cited

U.S. PATENT DOCUMENTS 1,833,426 A * 11/1931 Knudson ..... A61H 7/001 601/134
2,447,698 A 8/1948 Haberer et al.
(Continued)

FOREIGN PATENT DOCUMENTS

DE 29512018 U1 9/1995
DE 102 58 816 A1 9/2003

OTHER PUBLICATIONS

International Search Report and Written Opinion mailed Jan. 28, 2013, issued in corresponding International Application PCT/US12/50125.

(Continued)

*Primary Examiner* — Sarah W Aleman
(74) *Attorney, Agent, or Firm* — Squire Patton Boggs (US) LLP

(57) ABSTRACT

A neuromuscular therapy device and method is provided. The neuromuscular therapy device includes a top unit including a pair of square pyramidal bodies separated by a central valley. Each of the pair of square pyramidal bodies includes a top peak with vertices that are smoothly radiused. The neuromuscular therapy device may also include a base unit including a hollowed top central portion configured to provide a seat within which the top unit is secured.

15 Claims, 16 Drawing Sheets

(51) Int. Cl.
*A61H 1/02* (2006.01)
*A61H 7/00* (2006.01)

(56) References Cited

U.S. PATENT DOCUMENTS

| | | | | | |
|---|---|---|---|---|---|
| 4,159,020 | A | | 6/1979 | von Soiron | |
| 4,479,495 | A | | 10/1984 | Isaacson | |
| D351,235 | S | | 10/1994 | Yoo | |
| 5,864,969 | A | * | 2/1999 | Mauch | A43B 1/0054 36/141 |
| 6,036,719 | A | * | 3/2000 | Meilus | A61H 1/008 601/134 |
| 2004/0059267 | A1 | | 3/2004 | Kancilja et al. | |
| 2005/0165450 | A1 | * | 7/2005 | Perez-Torrens | A61H 1/0292 606/240 |
| 2009/0241238 | A1 | | 10/2009 | Rego | |
| 2010/0049106 | A1 | | 2/2010 | Gueret | |
| 2010/0236560 | A1 | * | 9/2010 | Rambo | A61F 5/01 128/845 |

OTHER PUBLICATIONS

European Search Report application No. 12821796.5 dated Mar. 13, 2015.
The Upledger Institute International, Inc. "Still Point Inducer" www.stillpointinducer.com, Retrieved on Sep. 6, 2016. pp. 1-3.
European Examination Report dated Dec. 22, 2016, issued in EP corresponding Application No. 12 821 796.5.

* cited by examiner

NEUROMUSCULAR THERAPY DEVICE AND METHOD

CROSS REFERENCE TO RELATED APPLICATIONS

This application claims priority to provisional patent application No. 61/521,418, filed on Aug. 9, 2011. The entire contents of this earlier filed application are hereby incorporated by reference in its entirety.

BACKGROUND

Field

The disclosed embodiments of the present invention generally relate to devices and methods, used singularly or together, for reducing muscular tension, otherwise providing neuromuscular therapy, or joint mobilization.

Description of the Related Art

Neuromuscular aches and pains, particularly those of a chronic nature, are known to be resolved with neuromuscular therapy. However, neuromuscular therapists are not always available or convenient. Additionally, some neuromuscular therapy techniques may be ineffective. It is known that applying pressure to trigger points or other neuromuscular anatomical locations (e.g., nerves) against an object can provide therapeutic benefits. However, many objects are too rigid and unyielding and other objects, such as a tennis ball, are resilient, but may deflate and provide little lateral rigidity.

It is therefore an unmet need in the prior art to provide a device that will retain its place on a floor, grip to a wall, or other surface while providing a resilient surface against which the muscle area may be pressed or levered, as well as a device that specifically targets muscle groups in a manner that provides quick and continuous relief of neuromuscular aches and pains.

SUMMARY

One embodiment is directed to a neuromuscular therapy device. The neuromuscular therapy device includes a top unit including a pair of square pyramidal bodies separated by a central valley. Each of the pair of square pyramidal bodies includes a top peak with vertices that are smoothly radiused. The neuromuscular therapy device may also include a base unit including a hollowed top central portion configured to provide a seat within which the top unit is secured.

Another embodiment is directed to a method of neuromuscular therapy. The method includes placing a neuromuscular therapy device against a flat surface. The neuromuscular therapy device includes a pair of square pyramidal bodies separated by a central valley, where each of the pair of square pyramidal bodies includes a top peak with vertices that are smoothly radiused. The method may further include positioning a user on the neuromuscular therapy device to exert pressure against a therapeutic anatomical target of the user. The therapeutic anatomical target to which pressure is exerted may include at least one of the sub-occipital, the erector spinae group, multifidi and short posterior sacroiliac ligaments and associated trigger points.

Another embodiment is directed to a neuromuscular therapy device. The neuromuscular therapy device includes applying means for applying anatomical pressure to a user. The applying means includes a pair of square pyramidal bodies separated by a central valley, where each of the pair of square pyramidal bodies includes a top peak with vertices that are smoothly radiused. The neuromuscular therapy device may also include base means comprising a hollowed top central portion for providing a seat within which the applying means is placed.

BRIEF DESCRIPTION OF THE DRAWINGS

For proper understanding of the invention, reference should be made to the accompanying drawings, wherein:

FIG. 9 illustrates, in top plan view, the FIG. 8 embodiment fully assembled;

FIG. 11 illustrates, in bottom plan view, an assembled example of a neuromuscular therapy device according to an embodiment;

DETAILED DESCRIPTION

Figure 1:
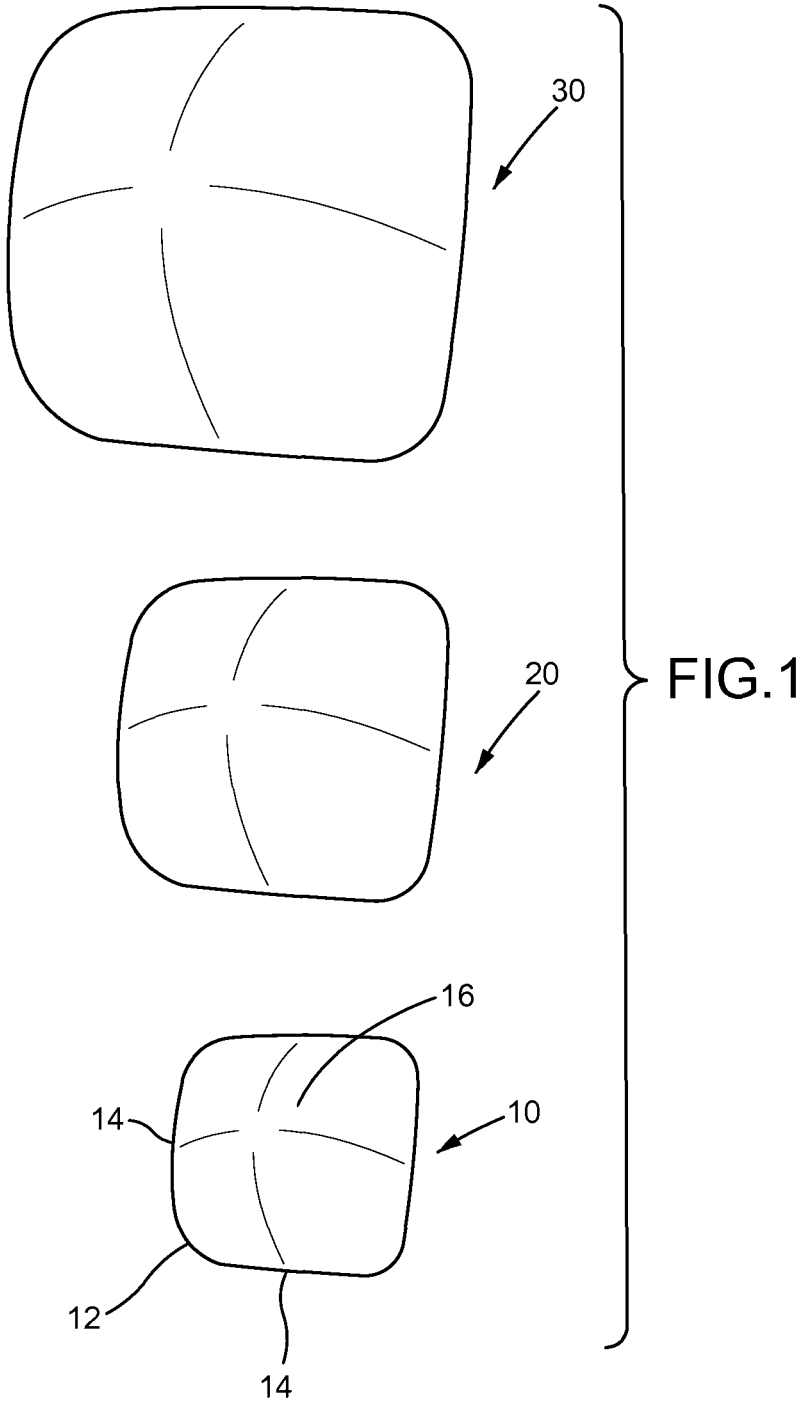
FIG. 1 illustrates a top plan view of three units of an embodiment of the invention.

FIG. 1 illustrates three units 10, 20, 30 of a neuromuscular therapy device, according to a first embodiment of the invention. When viewed in this top plan view, the bottom perspective views of FIG. 2, and the front perspective view in FIG. 3 of unit 10, the primary structure of each of the units 10, 20, 30 will be understood.

Each of the units 10, 20, 30 can be characterized as a square pyramidal body that has each vertex smoothed off, or radiused. Because the three units 10, 20, 30 differ from each other primarily in size, description of each of them can be achieved by providing a more detailed description of base unit 10, as follows.

As illustrated in FIG. 1, the four base vertices 12 of base unit 10, where base edges 14 meet, are each smoothly radiused. Top peak 16 is also smoothly radiused. According to one embodiment, the preferred material of construction of units 10, 20, 30 is a thermoplastic elastomer, such as a non-latex rubber, that can be molded.

Figure 2:
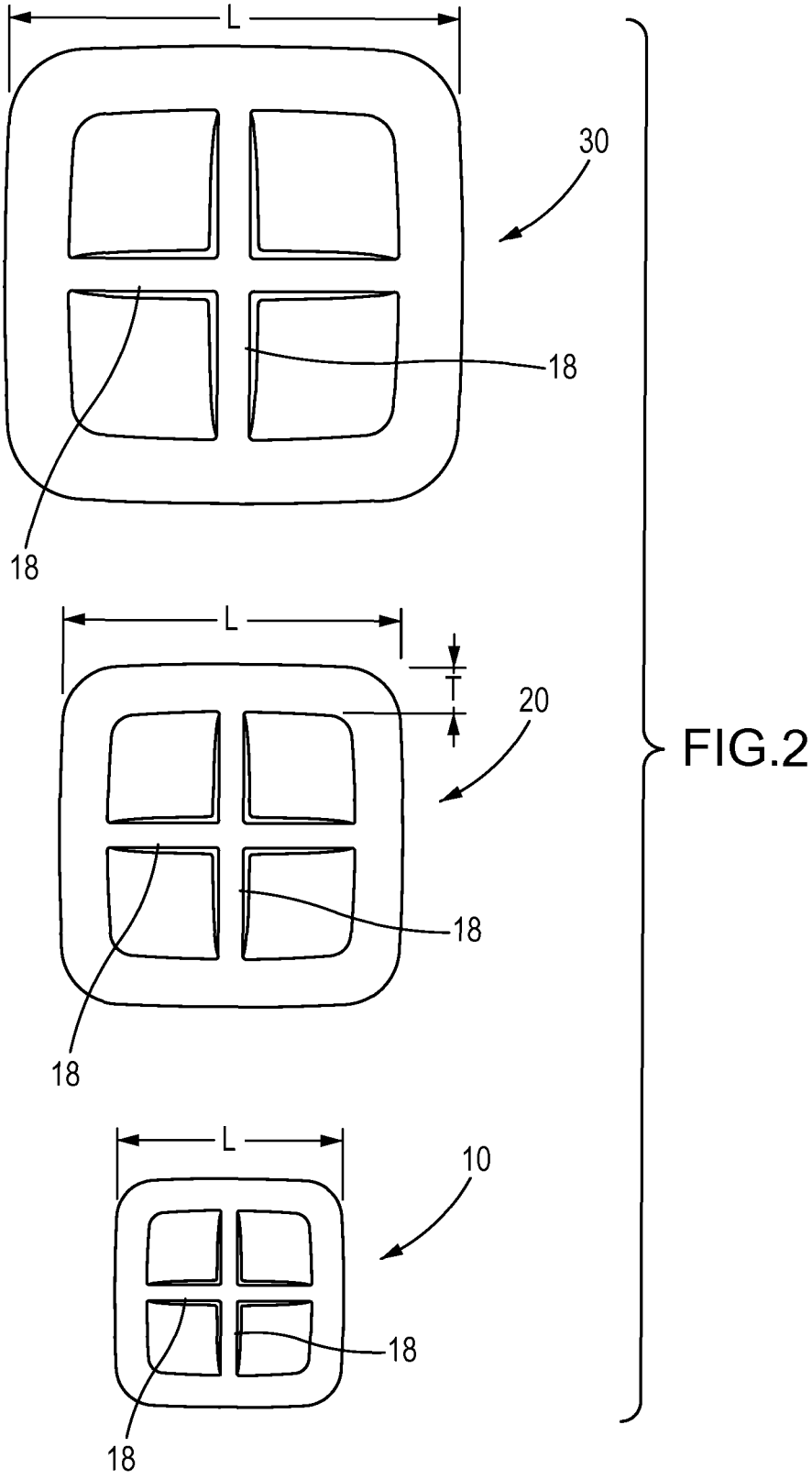
FIG. 2 illustrates a bottom perspective view of the FIG. 1 embodiment units.

FIG. 2 illustrates that the units 10, 20, 30 may not be solid. As illustrated in FIG. 2, in an embodiment, each of the units 10, 20, 30 has a wall thickness T that is essentially consistent within the group, even though the units may differ in edge length L and also in height, which varies proportionately with the edge length among the units 10, 20, 30. According to one embodiment, wall thickness T is substantially constant throughout the body of the unit 10, 20, 30, providing a hollow volume that lends flexibility to the units 10, 20, 30.

In one embodiment, units 10, 20, 30 may be used as a neuromuscular therapy device configured to target and treat muscular aches and pains. Units 10, 20, 30 can be used to target many of the same muscles as the bi-lobed units that will be described in more detail below. However, these mono-lobed units 10, 20, 30 are designed to function further from the sagittal plane of the user. For example, according to an embodiment, muscle groups that can be targeted with units 10, 20, 30, used either individually or in combination, include the Latissimus dorsi, Infraspinatus, Romboideus, Deltoid, Teres Minor, Teres Major, and associated trigger points.

In one embodiment, units 10, 20, 30 may be further configured to facilitate applying pressure to the foot, especially the sole, via a standing position of the user, whereby the user maintains balance on one foot while lowering their body weight onto a part as to apply selective pressure to the bottom of the opposite foot. This method can be used therapeutically for plantar fasciitis, reflexology, and calf stretches, for example. Often, physical therapists use tennis balls for a similar effect. Units 10, 20, 30 are considered superior for that application as they are more laterally stable and durable.

In some embodiments, the units, 10, 20, 30, and especially the larger units 20, 30, may be used as a hand rest for the temporary wrist alignment and possible relief of carpel tunnel symptoms. To accomplish this goal, users place the unit 10, 20, 30 beside a keyboard. When not actively typing or using a mouse, the hand is gently rested over the unit to align the wrist, alleviating internal stresses.

In one embodiment, the units 10, 20, 30 include a pair of intersecting cross elements 18, as illustrated in FIG. 2. These cross elements 18 may originate in the center of one of the base edges 14 and pass to the center of the opposite base edge 14. The cross elements 18 in the pair intersect at the middle of the hollow volume in a perpendicular fashion. Each cross element 18 may be integrally molded into the unit 10, 20, 30. The cross elements 18 can serve to provide additional rigidity while still reducing the amount of material that would be required if the units 10, 20, 30 were solid.

Figure 3:
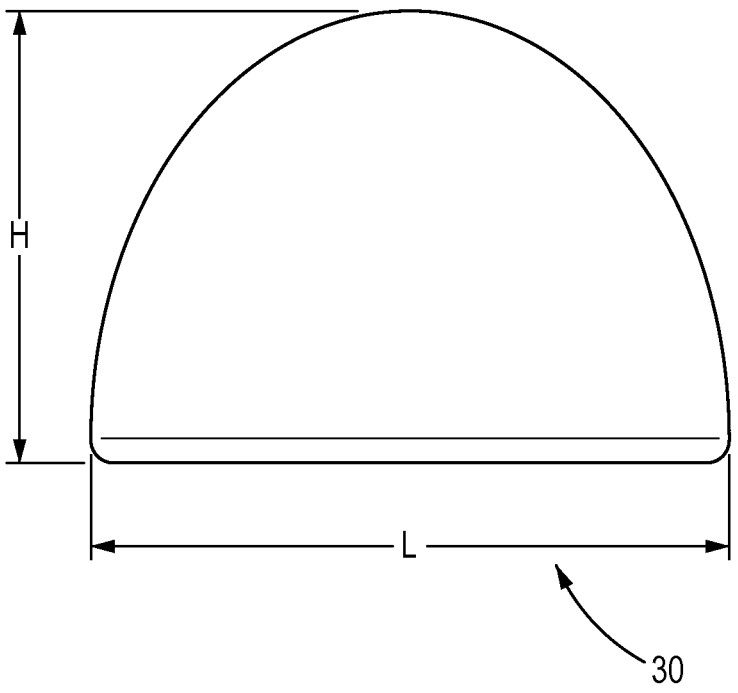
FIG. 3 illustrates a front perspective view of one of the FIG. 1 embodiment units.

According to one embodiment, as illustrated in FIG. 3, the height H to length L ratio of any of the units 10, 20, 30 may be in the range of about 0.6:1.0 to about 0.9:1.0. An advantage of this height H to length L ratio range is that the units 10, 20, 30 are tall enough to be effectively used, while still providing a strong base for supporting weight and providing lateral stability.

The units 10, 20, 30 of this embodiment can be used individually or together, and, when used together, can be used in multiples of the same size (such as two units 10) or in different sizes (such as a unit 10 used together with a unit 30). The flat lower surface provided by the rectangular base edges (or, in the particularly illustrated embodiment, the square base edges) is conducive to the unit being placed on a flat surface, such as on a floor or against a wall. The user can place a body part atop the unit. By moving the body part around, the body weight exerted onto the unit allows massage of muscle groups. Because of the smoothed radii and the inherent flexibility of the units 10, 20, 30, the force is evenly distributed across the skin area in contact with the unit. The square base and extending vertical flat surfaces increase the surface area or vertical ridge, giving the user a further degree of flexibility in establishing a contact surface from applying pressure.

Figure 4:
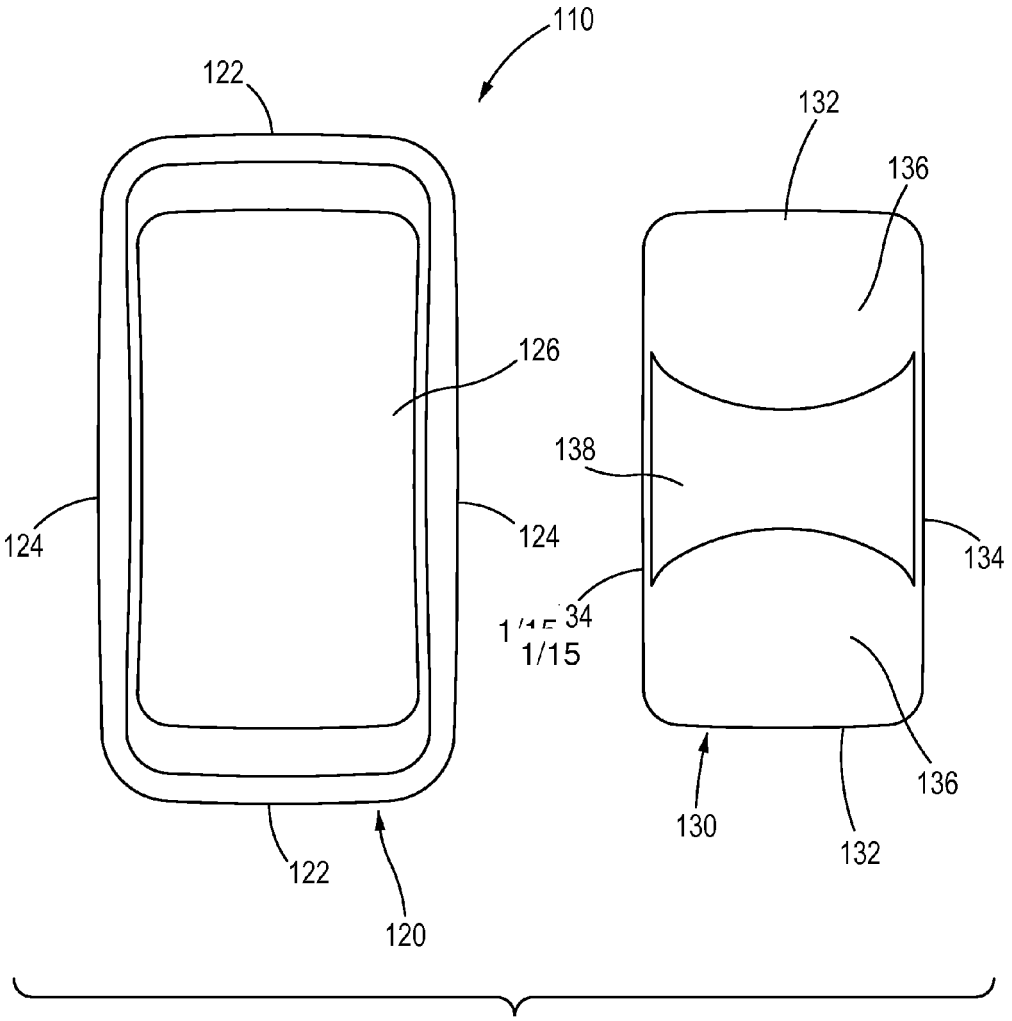
FIG. 4 illustrates a top plan view of an embodiment of the invention, in an unassembled state.
Figure 5A:
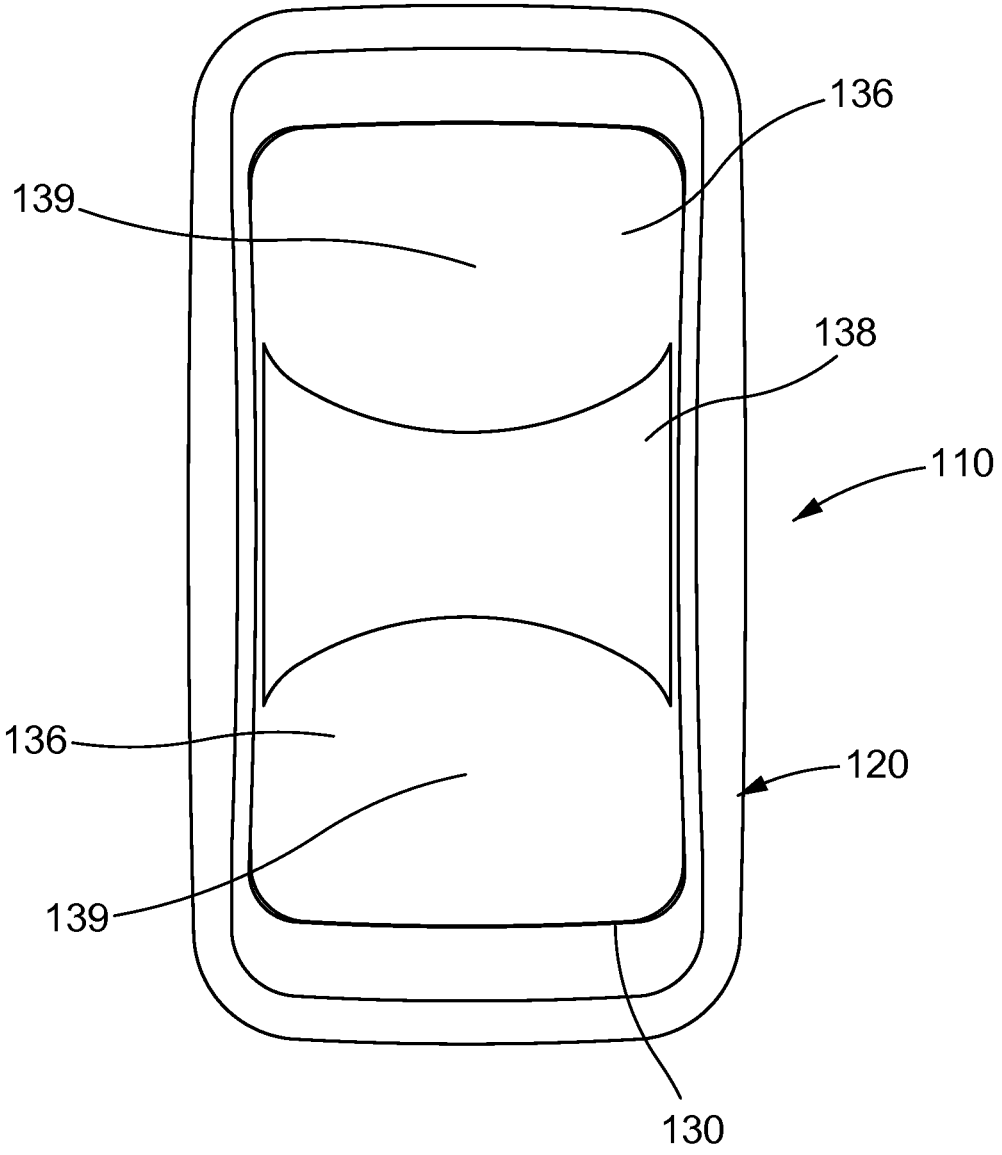
FIG. 5*a* is a top plan view of the FIG. 4 unit in an assembled state.
Figure 5B:
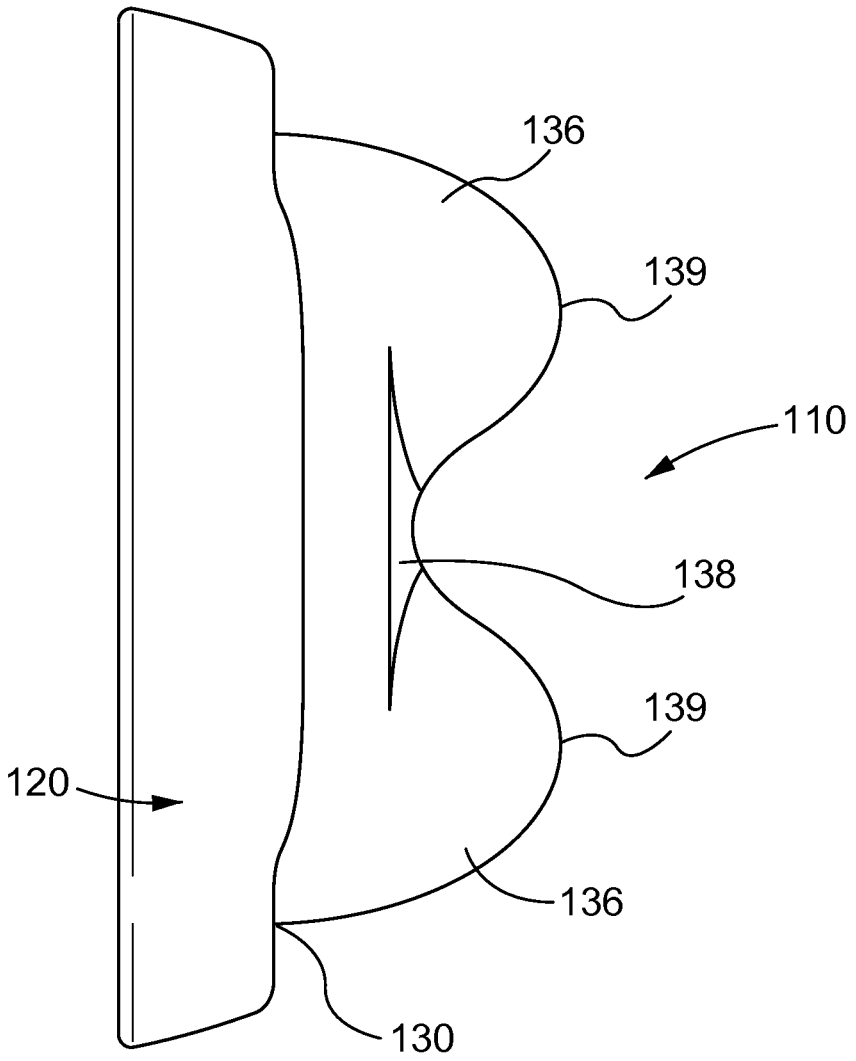
FIG. 5*b* is a side view of the FIG. 4 unit in an assembled state.

FIG. 4 illustrates an unassembled view of a neuromuscular therapy device 110, according to a second embodiment of the invention. FIG. 5*a* illustrates an assembled top plan view of the neuromuscular therapy device 110, and FIG. 5*b* illustrates a side view of the neuromuscular therapy device 110, according to embodiments.

In one example, the device 110 includes a base unit 120 and a top unit 130. The base unit 120 is intended for optional use with both the top unit 130 and a base unit 310 illustrated in FIG. 12 discussed below. Base unit 120 is generally characterized by a rectangular profile in top plan view with end edges 122 and side edges 124. A top central portion 126 of base unite 120 may be hollowed, providing a seat within which top unit 130 may be placed, as is particularly illustrated in FIG. 5.

In one embodiment, top unit 130 may have a rectangular profile in top plan view with end edges 132 and side edges 134 that are sized and adapted to allow top unit 130 to be received in the top central portion 126 of base unit 120, as illustrated in FIG. 5. Viewed from the top in either FIG. 4 or 5, top unit 130 is characterized by a pair of square pyramidal bodies 136 that are separated by a central valley 138.

As with units 10, 20, 30 of the first embodiment, these square pyramidal bodies 136 have vertices that are smoothed off, or radiused, but particularly the top peak 139, which would correspond to top peak 16 in the units 10, 20, 30. According to an embodiment, top unit 130 is configured to apply anatomical pressure to muscle groups including the Erector Spinae Group, Multifidus and Short Posterior Sacroiliac Ligaments and associated trigger points while avoiding the iliac crest and spinous process when used in the lower back region of a user.

Accordingly, in one example top unit 130 is a bi-lobed unit, with each of the lobes formed by the pyramidal bodies 136 with top peaks 139, which maintains the two lobes in fixed spatial relationship. In one embodiment, the distance or gap between the top peaks 139 is in a range of between 3.5 and 5.9 centimeters. In an embodiment, the gap between the top peaks 139 is designed to accommodate the attachment point of the Multifidus that is about 1.3 centimeters from each side of the spinous process. In one embodiment, the crest of top peaks 139 curve inward toward each other and the central valley 138 such that the top peaks 139 can hook onto the muscle groups, such as the Sub-Occipital, Erector Spinae Group, Multifidus and Short Posterior Sacroiliac Ligaments, to provide anatomical pressure and relief from aches and pains.

As with the first embodiment, an example of the material of construction of neuromuscular therapy device 110 is a thermoplastic elastomer, such as a non-latex rubber, that can be molded. In an embodiment, the hardness of neuromuscular therapy device 110, and specifically top unit 130, may be between 27 and 45 durometer on the shore scale of hardness. As in the first embodiment discussed above, the height to side length ratio of the individual pyramidal bodies 136 of top unit 130 may be in the range of from about 0.6:1.0 to about 0.9:1.0.

Figure 6:
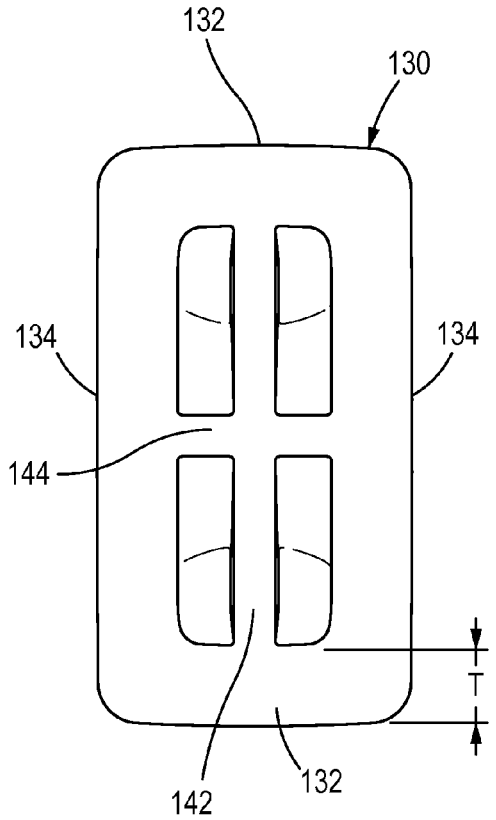
FIG. 6 illustrates, in bottom plan view, the top unit of the FIG. 4 embodiment.
Figure 7:
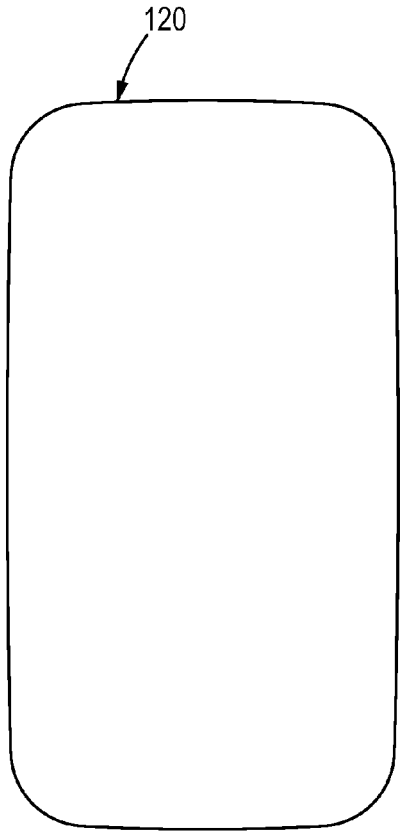
FIG. 7 illustrates, in bottom plan view, the base unit of the FIG. 4 embodiment.
Figure 8:
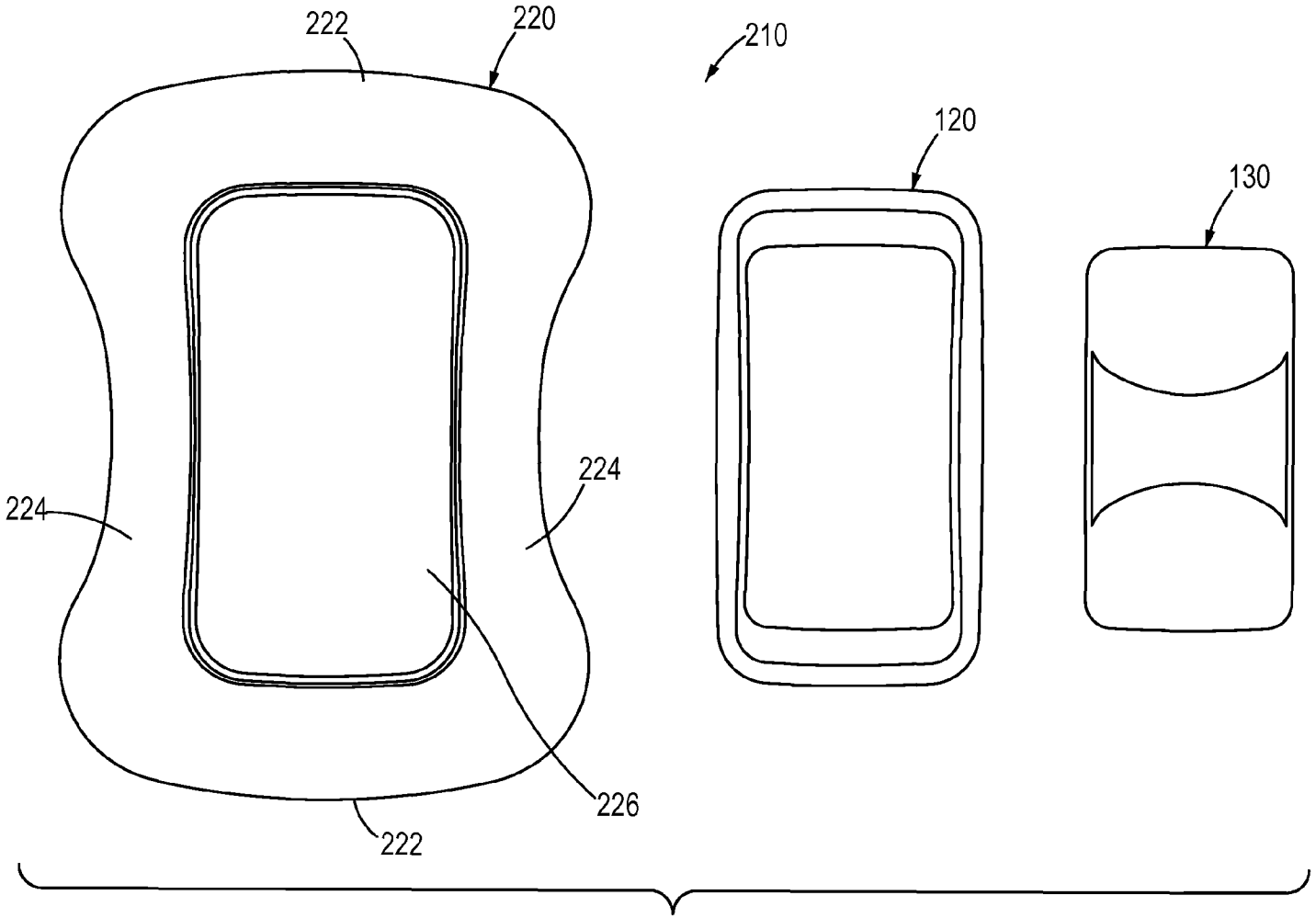
FIG. 8 illustrates, in top plan view, the unassembled FIG. 4 embodiment units with a further unit that can be used with them to provide another embodiment, unassembled in this illustration.

Referring now to FIGS. 6 and 7, bottom plan views of the top unit 130 and the base unit 120 of neuromuscular therapy device 110 are illustrated, according to an embodiment. Of these, base unit 120 may be a solid rectangular mass, with the top central portion 126 being a hollow portion, which is not visible in FIG. 7. However, top unit 130 may not be solid. In one example, top unit 130 may have a wall thickness T, which leaves a hollow volume that lends flexibility to the unit. This flexibility is tempered somewhat by the inclusion of a pair of intersecting cross elements 142, 144. Unlike the first embodiment, which had a square profile, the cross elements 142, 144 of top unit 130 differ from each other, because of the rectangular profile. Cross element 142 joins the end edges 132, so it is longer than cross element 144 which joins the side edges 134 underneath central valley 138 (not visible in FIG. 6). The cross elements 142, 144 intersect at the middle of the hollow volume in a perpendicular fashion and each cross element is integrally molded into the top unit 130.

The use of the neuromuscular therapy device 110 is to apply pressure to certain muscle groups of a user to relieve muscle aches and pains. One use for base unit 120 is to raise the elevation of the top unit 130, which can be used by itself to massage a selected muscle mass of a user when that muscle area is exerted against the top unit 130. Base unit 120 can also be used to accommodate variations in carpet pile or the anatomy of the user, such as subcutaneous fat or the degree of back arch.

FIGS. 8 through 11 illustrate a third embodiment 210 that can be constructed using base unit 120 and top unit 130 of second embodiment 110 with a further sub-base unit 220. This third embodiment 210 is seen in an unassembled top plan view in FIG. 8, a partially assembled top plan view in FIG. 9, a fully assembled top plan view in FIG. 10, and a fully assembled perspective view in FIG. 11.

Figure 9:
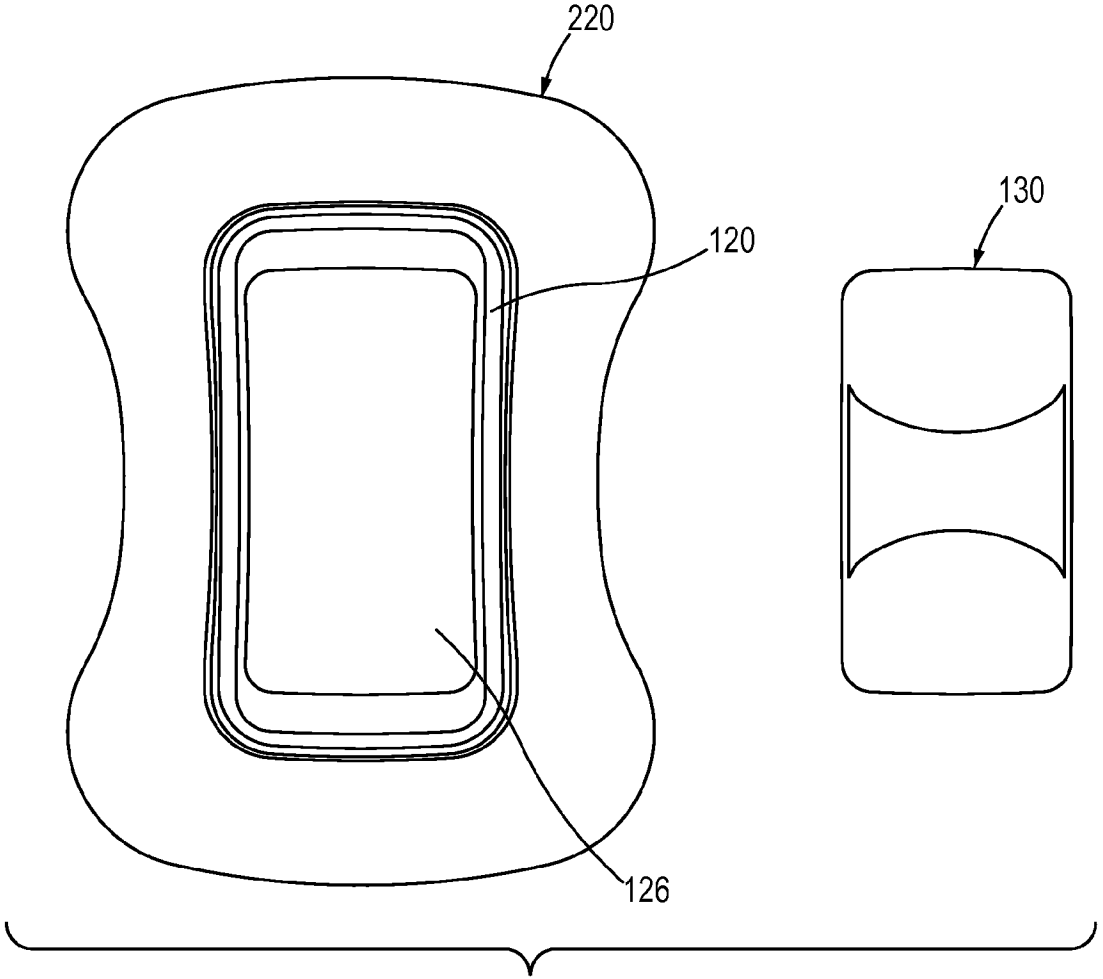
FIG. 9 illustrates, in top plan view, a partially assembled FIG. 8 embodiment.
Figure 10:
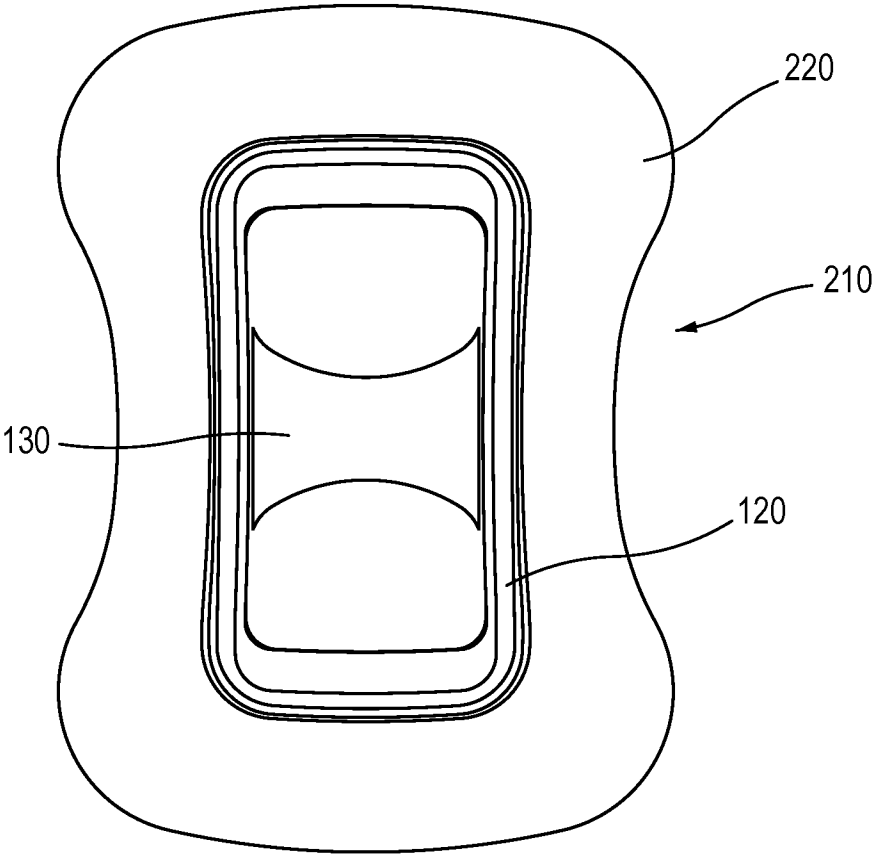
FIG. 10 illustrates, in top plan view, a fully assembled FIG. 8 embodiment.
Figure 11:
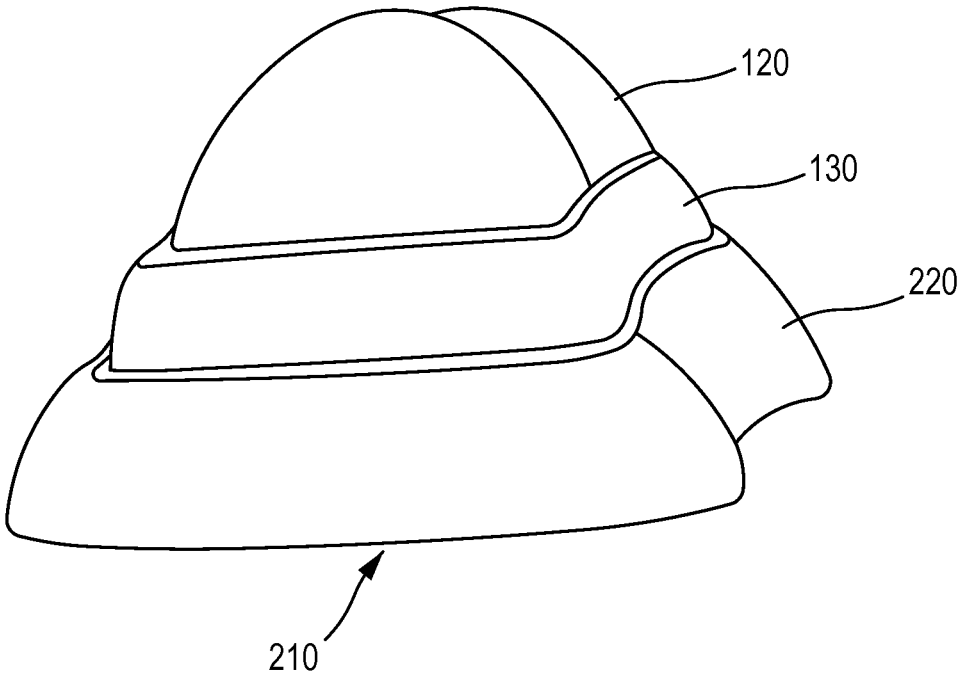
FIG. 11 illustrates, in side perspective view, the assembled FIG. 8 embodiment.

Base unit 120 and top unit 130 were discussed in detail above. Attention is now directed, therefore, to the sub-base unit 220. In one embodiment, sub-base unit 220 has a rectangular profile in plan view, defined by end edges 222 and side edges 224. A central hollow portion 226 on the top surface of sub-base unit 220 is sized and configured to receive the base unit 120 directly (and the top unit 130 mounted on the base unit indirectly) in frictional engagement. This use is illustrated in FIGS. 9 and 10, where the base unit 120 is inserted into the central hollow portion 226 of sub-base unit 220 and then top unit 120 is inserted into central portion 126. Of course, it is understood that a fully assembled device 110 can have base unit 120 seated in central hollow portion 226 in a single step, but the stepwise assembly is shown for illustrative purposes. The ability of sub-base unit 220 to raise the elevation of top unit 130 is shown in a perspective view in FIG. 11.

Figure 12:
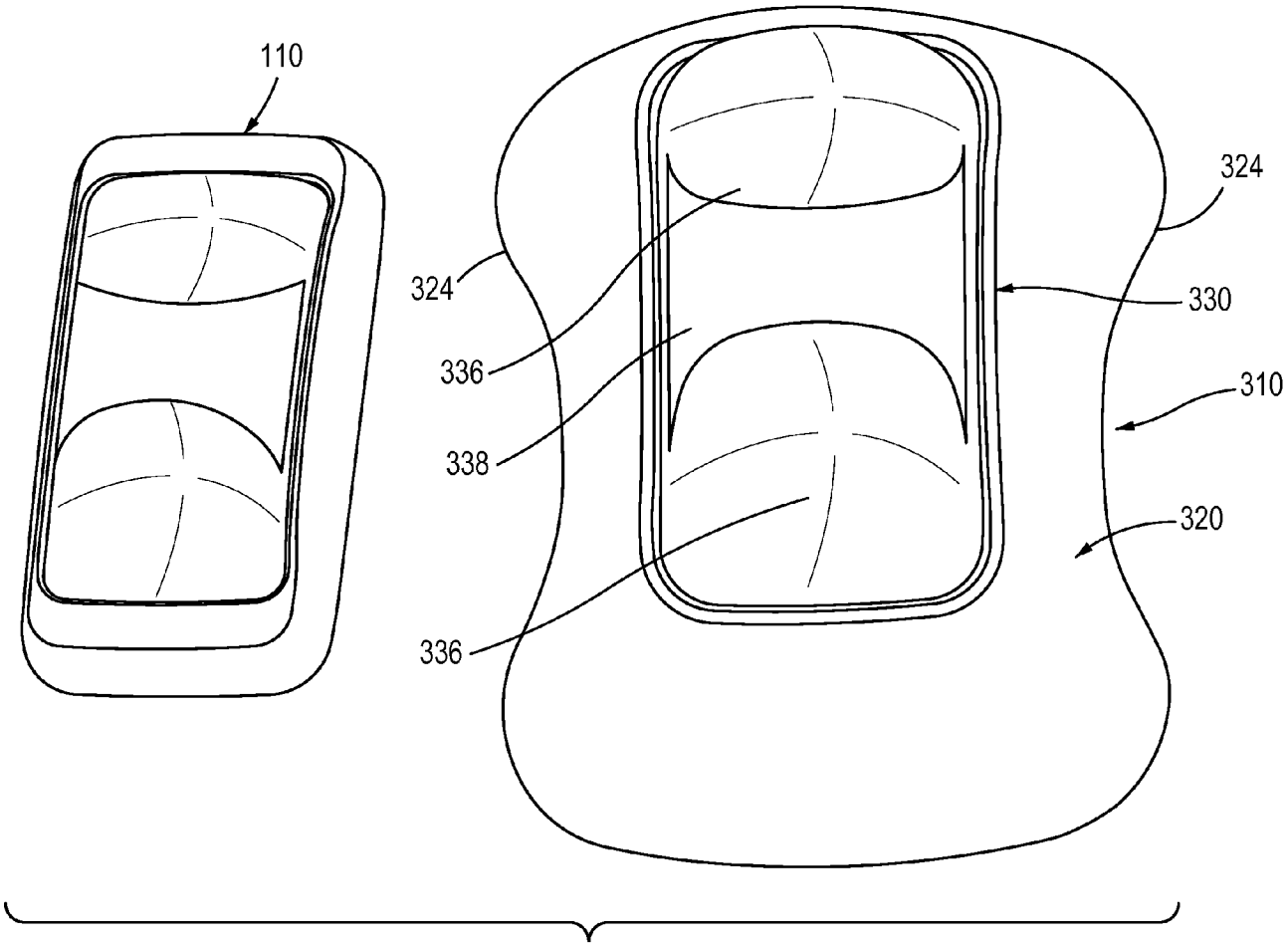
FIG. 12 illustrates, in top plan view, another embodiment that is depicted in juxtaposition to the FIG. 4 embodiment.
Figure 13:
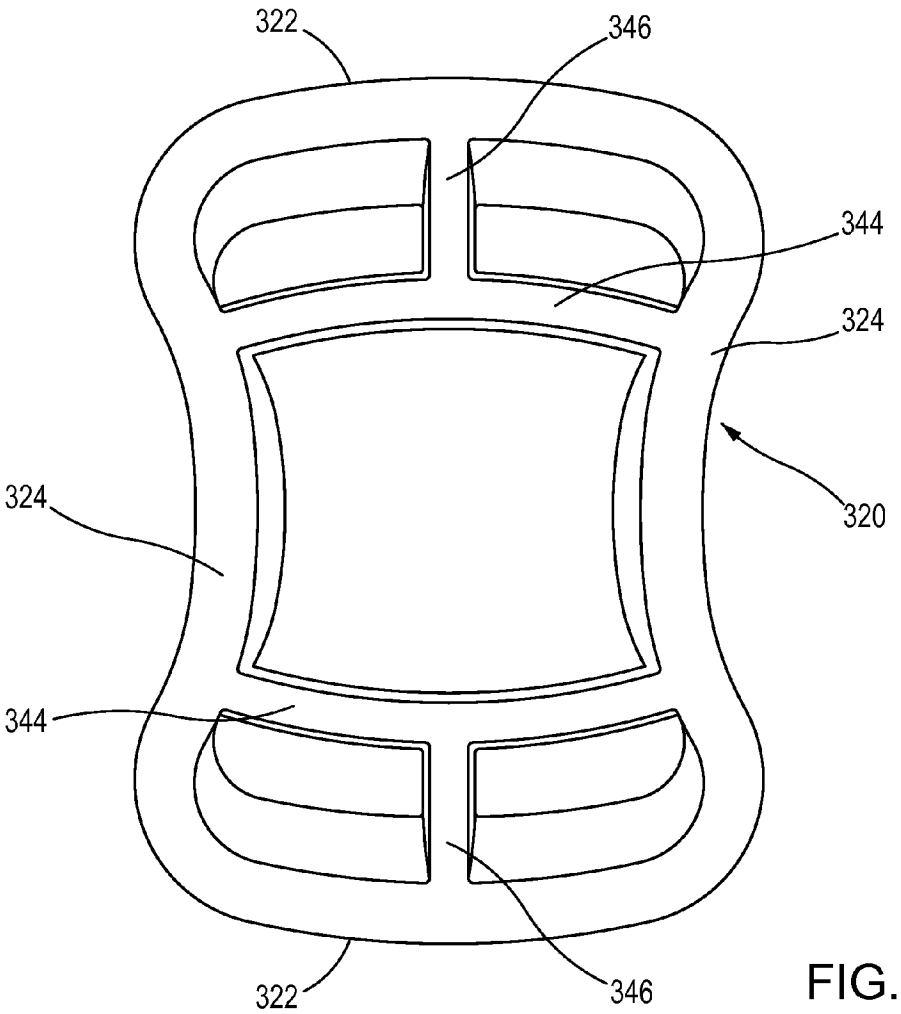
FIG. 13 illustrates, in bottom plan view, the base unit of the FIG. 12 embodiment.
Figure 14:
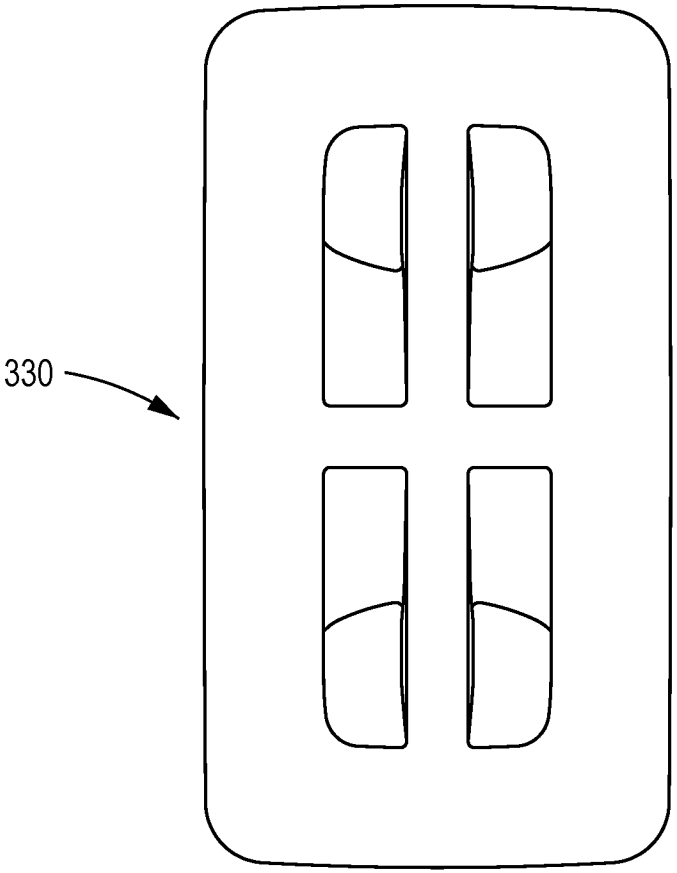
FIG. 14 illustrates, in enlarged bottom plan view, the top unit of the FIG. 12 embodiment.

FIGS. 12 through 14 illustrate yet a further device 310, according to another embodiment. FIG. 12 illustrates a top plan view of the device 310 juxtaposed with embodiment 110, for size comparison purposes. In comparison to device 110, device 310 includes a larger top unit 330 with larger pyramidal bodies 336 and to provide a higher elevation using only a single base unit 320, molded from a thermoplastic elastomer, for example. A central valley 338 connects the respective pyramidal bodies 336. Instead of having the rectangular profile in plan (as in device 110), device 330 has a somewhat "dogbone" shape, by imposing an arcuate bend along side edges 324.

Top unit 330 may be configured specifically to target, but not limited to, certain muscle groups including the Trapezus, Semispinalis Capitis, Splenius Capitus, Occipitalis and associated trigger points while avoiding the spine. Further, by rotating the device 310 a user is able to target the Levator Scapulae and associated trigger points without moving from a prone position.

FIG. 13 illustrates, in bottom plan, view how some of the increased rigidity desired in the base unit 320 can be achieved without requiring the additional weight (and cost) of a solid molded piece (as exemplified by base unit 120). Cross elements 344 that connect side edges 324 are deformed somewhat from the linear to provide arcuate connections, which work with side edges 324 to form a somewhat deformed rectangle. A cross element 346 connects a midpoint of cross element 344 with the corresponding end edge 322.

To provide a comparison, an enlarged bottom plan view of top unit 330 illustrates how it is similar to the bottom view of top unit 130 (as seen in FIG. 6). This use of the cross elements there is to maintain elasticity in the top unit 330, so it deforms preferentially to base unit 320.

Figure 15A:
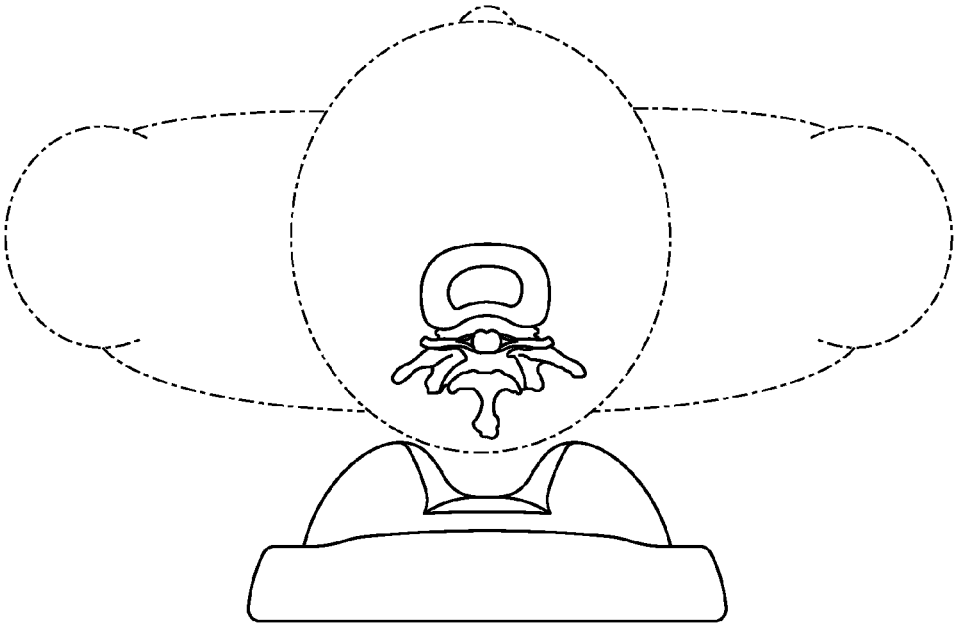
FIG. 15A illustrates an example of the device in use, according to an embodiment.
Figure 15B:
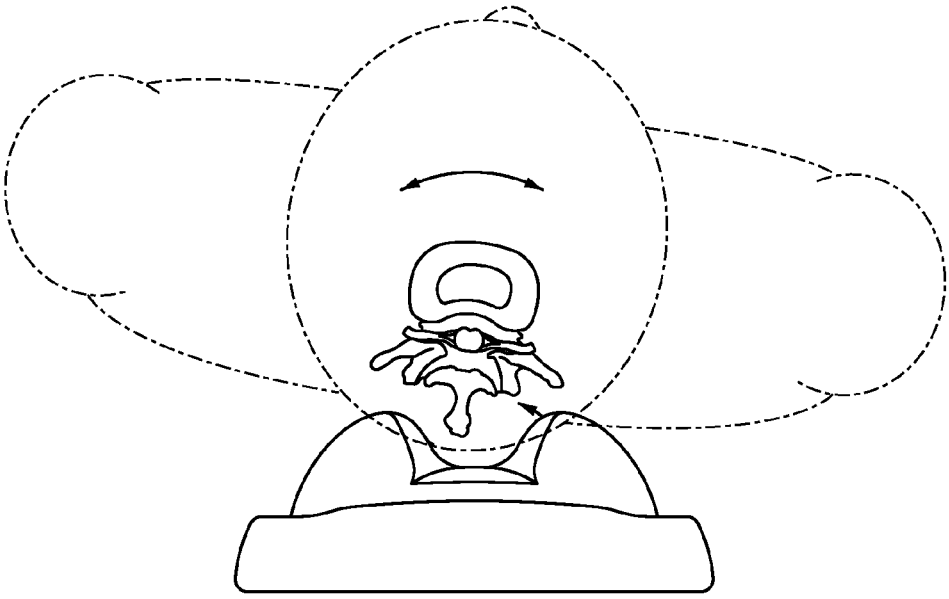
FIG. 15B illustrates an example of the device in use, according to another embodiment.

FIGS. 15A and 15B illustrates an example of device 110 (or device 310) being used to provide neuromuscular therapy to a user 400, according to one embodiment. As illustrated in FIG. 15A, device 110 may be placed on a flat surface, such as the floor or a wall. The user 400 may then lay or stand against device 310 thereby applying pressure to certain muscle groups 410 in the back of the user 400, for example. In one embodiment, when the user 400 lays or stands against device 310, it applies anatomical pressure to the Multifidus, Erector Spinae Group, and/or Short Posterior Sacroiliac Ligaments and associated trigger points, while avoiding the iliac crest and spine when used in the lower back region of a user. FIG. 15B illustrates that the user may also rock laterally from side to side to provide additional pressure to a range of muscles.

Figure 16:
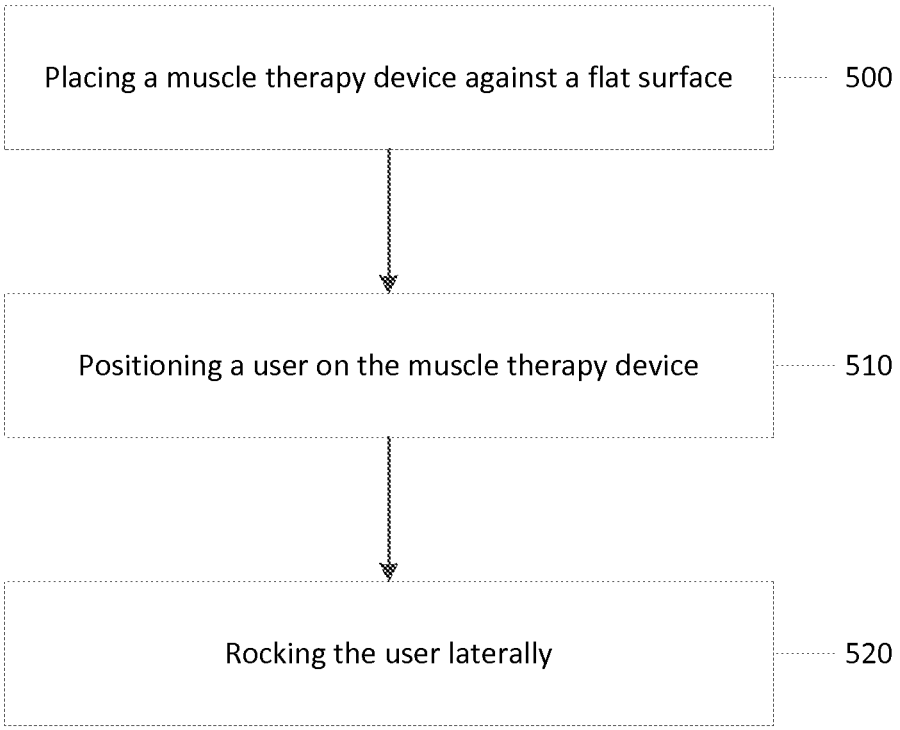
FIG. 16 illustrates a flow diagram of a method for neuromuscular therapy, according to one embodiment.

FIG. 16 illustrates an example of a flow chart of a method of neuromuscular therapy, according to one embodiment. As illustrated in FIG. 16, the method may include, at 500, placing a muscle therapy device against a flat surface. As outlined above, the muscle therapy device may include a pair of square pyramidal bodies separated by a central valley, such that each of the pair of square pyramidal bodies includes a top peak with vertices that are smoothly radiused. The method may further include, at 510, positioning a user or patient on the muscle therapy device to exert pressure against a muscle of the user or patient. The muscle to which pressure is applied may include, for example, the erector spinae group, multifidus and/or short posterior sacroiliac ligaments and associated trigger points. In an embodiment, the method may also include, at 520, shifting or rocking the user laterally such that the muscle therapy device hooks into a gap between a spinous process and transverse process in a back of the user.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

We claim:

1. A neuromuscular therapy device, comprising:

a top unit comprising a pair of square pyramidal bodies separated by a central valley, wherein each of the pair of square pyramidal bodies comprises a top peak with vertices that are smoothly radiused; and a base unit comprising a recessed platform, wherein the recessed platform corresponds and is configured to receive an entire bottom perimeter of the top unit.

2. The neuromuscular therapy device according to claim 1, wherein the top peaks curve inward toward the valley.

3. The neuromuscular therapy device according to claim 1, wherein the top unit is made of a thermoplastic elastomer.

4. The neuromuscular therapy device according to claim 1, wherein the top unit has a shore durometer hardness in a range of between 27 and 45.

5. The neuromuscular therapy device according to claim 1, wherein a distance between the top peaks is in a range of between 3.5 and 5.9 centimeters.

6. The neuromuscular therapy device according to claim 1, wherein the top unit is configured to apply anatomical pressure to an erector spinae group, multifidus and short posterior sacroiliac ligaments and associated trigger points while avoiding the iliac crest and spine when the top unit is applied against a lower back of a user.

7. The neuromuscular therapy device according to claim 1, wherein a height to side length ratio of the pyramidal bodies of the top unit is in the range of from 0.6:1.0 to 0.9:1.0.

8. A method of neuromuscular therapy, the method comprising:

placing a neuromuscular therapy device against a flat surface, the neuromuscular therapy device comprising a pair of square pyramidal bodies separated by a central valley, wherein each of the pair of square pyramidal bodies comprises a top peak with vertices that are smoothly radiused;

positioning a user on the neuromuscular therapy device to exert pressure against a therapeutic anatomical target of the user; and disposing the neuromuscular therapy device onto a recessed platform of a base unit, wherein the recessed platform corresponds and is configured to receive an entire bottom perimeter of the neuromuscular therapy device, and wherein the therapeutic anatomical target comprises at least one of the erector spinae group, multifidus and short posterior sacroiliac ligaments and associated trigger points.

9. The method of neuromuscular therapy according to claim 8, wherein the positioning comprises positioning the user on the muscle therapy device and shifting or rocking the user laterally such that the muscle therapy device hooks into a gap between a spinous process and transverse process in a back of the user.

10. A neuromuscular therapy device, comprising:

applying means for applying anatomical pressure to a user, the applying means comprising a pair of square pyramidal bodies separated by a central valley, wherein each of the pair of square pyramidal bodies comprises a top peak with vertices that are smoothly radiused; and base means comprising a recessed platform for receiving an entire bottom perimeter of the applying means, wherein the recessed platform corresponds to the entire bottom perimeter of the applying means.

11. The neuromuscular therapy device according to claim 10, wherein the top peaks curve inward toward the valley.

12. The neuromuscular therapy device according to claim 10, wherein the applying means is made of a thermoplastic elastomer.

13. The neuromuscular therapy device according to claim 10, wherein the applying means has a shore durometer hardness in a range of between 27 and 45.

14. The neuromuscular therapy device according to claim 10, wherein a distance between the top peaks is in a range of between 3.5 and 5.9 centimeters.

15. The neuromuscular therapy device according to claim 10, wherein the applying means applies anatomical pressure to a sub-occipital, erector spinae group, multifidus and short posterior sacroiliac ligaments and associated trigger points while avoiding the iliac crest and spine when the top unit is applied against a lower back of a user.

* * * * *